US010203632B2

(12) United States Patent
Furuta et al.

(10) Patent No.: US 10,203,632 B2
(45) Date of Patent: Feb. 12, 2019

(54) DEVELOPING DEVICE AND IMAGE FORMING APPARATUS

(71) Applicant: KONICA MINOLTA, INC., Chiyoda-ku, Tokyo (JP)

(72) Inventors: Tatsuya Furuta, Mitaka (JP); Hiroyuki Saito, Tokyo (JP); Tetsuya Ishikawa, Sagamihara (JP); Tomohiro Kawasaki, Sagamihara (JP); Ryoei Ikari, Tokorozawa (JP); Aiko Kubota, Hino (JP)

(73) Assignee: KONICA MINOLTA, INC, Chiyoda-Ku, Tokyo (JP)

( * ) Notice: Subject to any disclaimer, the term of this patent is extended or adjusted under 35 U.S.C. 154(b) by 0 days.

(21) Appl. No.: 15/866,610

(22) Filed: Jan. 10, 2018

(65) Prior Publication Data

US 2018/0217521 A1 Aug. 2, 2018

(30) Foreign Application Priority Data

Jan. 30, 2017 (JP) ..... 2017-014443

(51) Int. Cl.
*G03G 15/08* (2006.01)
*G03G 9/09* (2006.01)
(Continued)

(52) U.S. Cl.
CPC ..... *G03G 15/0867* (2013.01); *G03G 9/09* (2013.01); *G03G 9/097* (2013.01); *G03G 9/135* (2013.01); *G03G 15/0893* (2013.01)

(58) Field of Classification Search
CPC ..... G03G 15/0867; G03G 15/0891; G03G 2215/0819
See application file for complete search history.

(56) References Cited

U.S. PATENT DOCUMENTS

2004/0184843 A1* 9/2004 Sato ..... G03G 15/0808 399/283
2006/0165440 A1* 7/2006 Adachi ..... G03G 15/0844 399/254
(Continued)

FOREIGN PATENT DOCUMENTS

JP H 10-228175 A 8/1998
JP 2012-042839 A 3/2012
JP 2015-114541 A 3/2012

*Primary Examiner* — Sandra Brase
(74) *Attorney, Agent, or Firm* — Buchanan Ingersoll & Rooney PC

(57) ABSTRACT

A developing device, includes a first storage chamber that stores developer; a first conveyor that is disposed in the first storage chamber and conveys developer; a developer supporter that is disposed so as to face an image supporter, supports developer conveyed from the first conveyor, and conveys the supported developer to a developing position where an electrostatic latent image formed on the image supporter is developed; a second storage chamber that stores developer conveyed via the developing position and communicates with the first storage chamber at a confluent opening; a second conveyor that is disposed in the second storage chamber and conveys developer conveyed via the developing position toward the confluent opening; and a third storage chamber that stores developer overflowing in a case where an amount of developer in the second storage chamber becomes a predetermined amount or more.

14 Claims, 8 Drawing Sheets

(51) Int. Cl.
*G03G 9/097* (2006.01)
*G03G 9/135* (2006.01)

(56) References Cited

U.S. PATENT DOCUMENTS

| | | | | |
|---|---|---|---|---|
| 2007/0041750 | A1* | 2/2007 | Mizuta | G03G 15/0898 399/283 |
| 2012/0189352 | A1* | 7/2012 | Yamauchi | G03G 15/0893 399/258 |
| 2015/0003876 | A1* | 1/2015 | Iida | G03G 15/0891 399/254 |
| 2015/0168874 | A1 | 6/2015 | Ootsuka | |
| 2015/0338778 | A1* | 11/2015 | Matsumoto | G03G 15/0893 399/254 |
| 2016/0085181 | A1* | 3/2016 | Sakamaki | G03G 15/0893 399/257 |

* cited by examiner

DEVELOPING DEVICE AND IMAGE FORMING APPARATUS

CROSS-REFERENCE TO RELATED APPLICATION

The entire disclosure of Japanese patent application No. 2017-014443, filed on Jan. 30, 2017, is incorporated herein by reference in its entirety.

BACKGROUND

1. Technical Field

The present invention relates to a developing device and an image forming apparatus.

2. Description of Related Arts

Conventionally, as a developing system in image foil ling apparatuses using an electrophotographying system, two-component developing systems using two-component developer in which toner and carrier are mixed, have been known.

Generally, a developing device of such a two-component developing system includes a reservoir that mixes and stirs replenished toner with two-component developer, and the developing device is constituted so as to supply developer from the reservoir to a developing roller and to return again the developer, in which toner has been consumed at a developing position of the developing roller, to the reservoir.

For example, Patent Literature 1 (Japanese Unexamined Patent Publication No. 10-228175) discloses a developing device that includes a developing roller and a circulation conveyance passage disposed so as to adjoin the developing roller. The above circulation conveyance passage includes two conveyance screws that have respective conveyance directions opposite to each other and are disposed to become above and below each other in the inside, and communication ports disposed separately on the both side of the two conveyance screws, so that the circulation conveyance passage conveys developer circularly through the communication ports and functions as a reservoir.

With the constitution like Patent Literature 1 that supplies developer to the developing roller by the conveyance screw, image density unevenness may occur because of uneven developer supply.

For example, in a developing device disclosed by Patent Literature 2 (Japanese Unexamined Patent Publication No. 2012-42839), in order to prevent image density unevenness caused by developer supply unevenness due to a screw pitch of a conveyance screw to supply developer to a developing roller, a buffer chamber and a scraper are disposed to face a conveyance screw for supplying so as to unify a supply amount of developer to a developing roller by the conveyance screw in an axial direction.

SUMMARY

By the way, as image density unevenness caused by the supplying of developer to a developing roller, in addition, there is so-called ghost development (also, referred to as "development ghost"). Herein, the ghost development means density unevenness which occurs because replacement of the developer supported on a developing roller made for each rotation is insufficient. This phenomenon is caused by the fact that, when a toner image is formed on a photoconductor drum by consuming toner supported on a developing roller at a developing position, the influence of the toner consumption during the previous rotation remains on the surface of the developing roller even on the next rotation.

In particular, in the developing device disclosed by Patent Literature 1, in the case where an amount of developer increases on the side of the conveyance screw for conveying developer collected by being peeled off from the developing roller, the increased developer disturbs the flow of developer peeled off from the developing roller, which results in the lowering of peeling ability. For this reason, the replacement of the developer supported by the developing roller becomes insufficient, and ghost development becomes easy to occur.

Moreover, the developing device disclosed by Patent Literature 2 controls the amount of developer at the conveyance screw on the side of supplying to the developing roller, and does not control the amount of developer at the conveying screw on the side of recovery.

The present invention has been achieved in view of the above-described circumstances, and an object of the present invention is to provide a developing device and an image forming apparatus capable of preventing occurrence of ghost development stably even in a case where an amount of developer increases in the developing device.

To achieve at least one of the abovementioned objects, according to an aspect of the present invention, a developing device reflecting one aspect of the present invention, includes: a first storage chamber that stores developer; a first conveyor that is disposed in the first storage chamber and conveys developer; a developer supporter that is disposed so as to face an image supporter, supports developer conveyed from the first conveyor, and conveys the supported developer to a developing position where an electrostatic latent image formed on the image supporter is developed; a second storage chamber that stores developer conveyed via the developing position and communicates with the first storage chamber at a confluent opening; a second conveyor that is disposed in the second storage chamber and conveys developer conveyed via the developing position toward the confluent opening; and a third storage chamber that stores developer overflowing in a case where an amount of developer in the second storage chamber becomes a predetermined amount or more.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
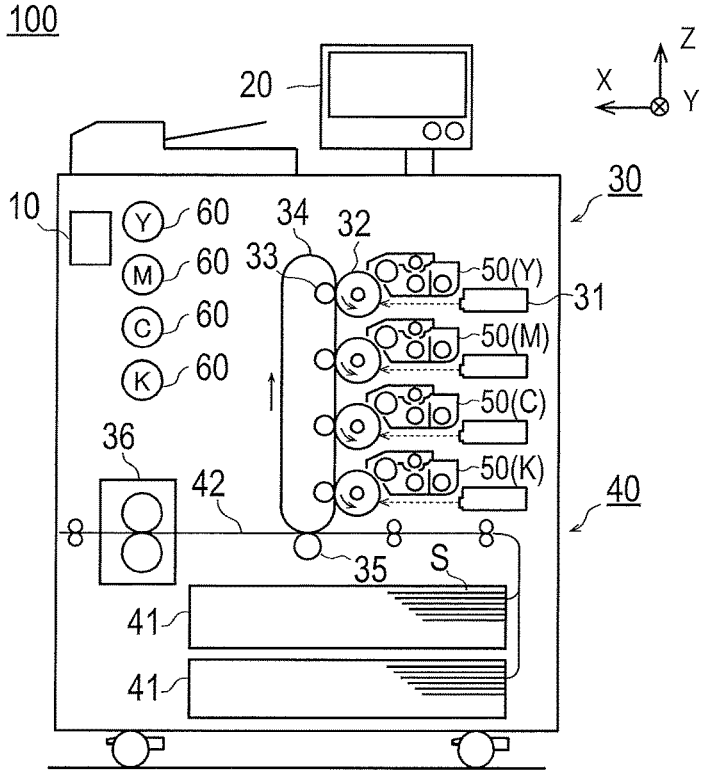
FIG. 1 is an illustration showing a schematic constitution of an image forming apparatus.

Hereinafter, one or more embodiments of the present invention will be described with reference to the drawings. However, the scope of the invention is not limited to the disclosed embodiments. In the description of the drawings, the same element is provided with the same sign, and duplicate description is omitted. Since dimension ratios in the drawings are exaggerated on account of description, the ratios may be different from the respective actual ratios. In the drawings, a vertical direction is set to a Z direction, a direction from one face of the front face and the rear face to the other face in an image forming apparatus is set to a Y direction, and a direction orthogonal to each of the X and Z directions is set to an X direction. Moreover, the Y direction serves also as a rotation axis direction of each of a developing roller and a stirring roller in a developing device installed in an image forming apparatus described below. Furthermore, hereinafter, the X direction may be called a left-right direction, and the Y direction may be called a front-back direction (or front-rear direction).

Figure 2:
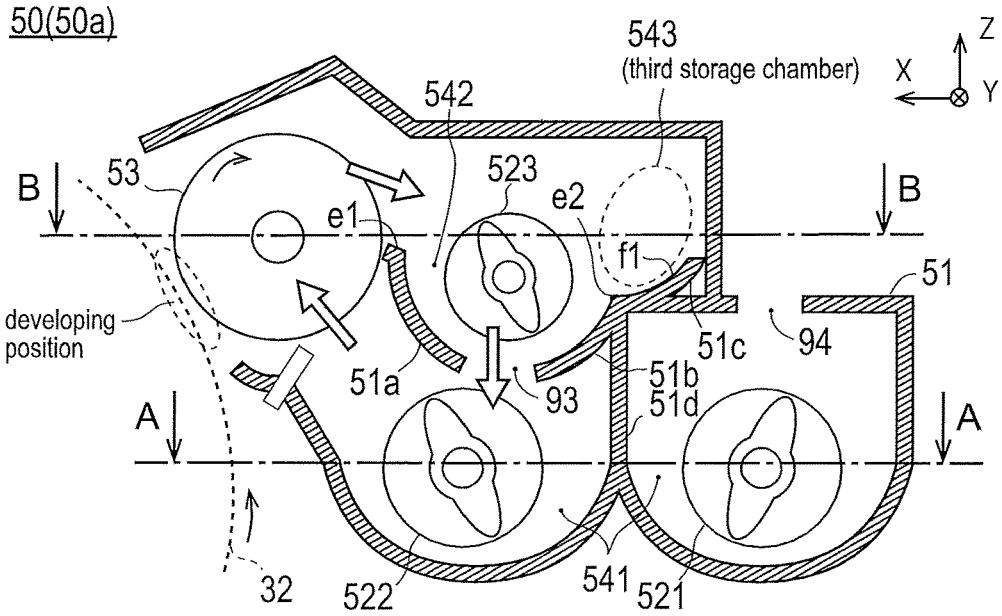
FIG. 2 is a cross sectional view of a developing device according to a first embodiment.
Figure 3A:
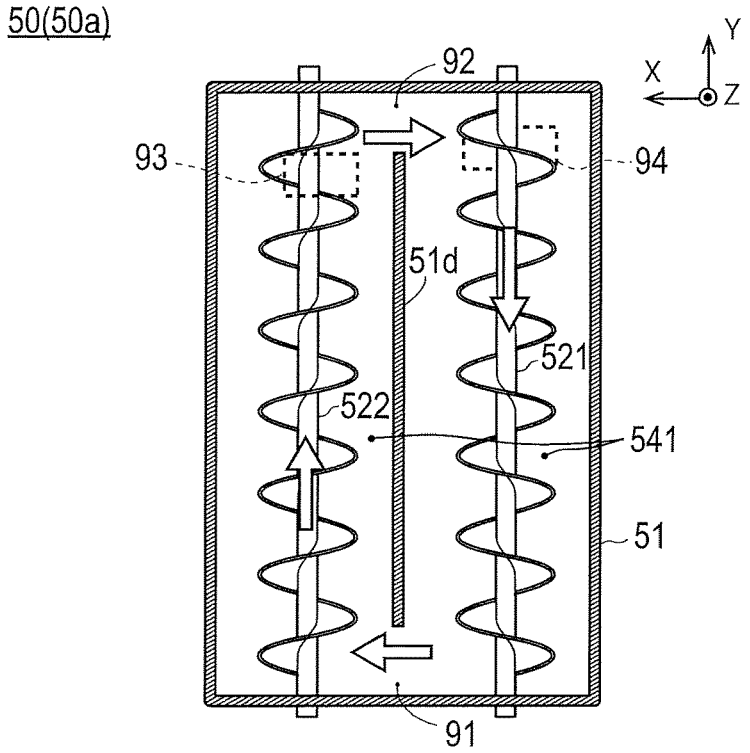
FIG. 3A is a plan view on an A-A line position in FIG. 2.
Figure 3B:
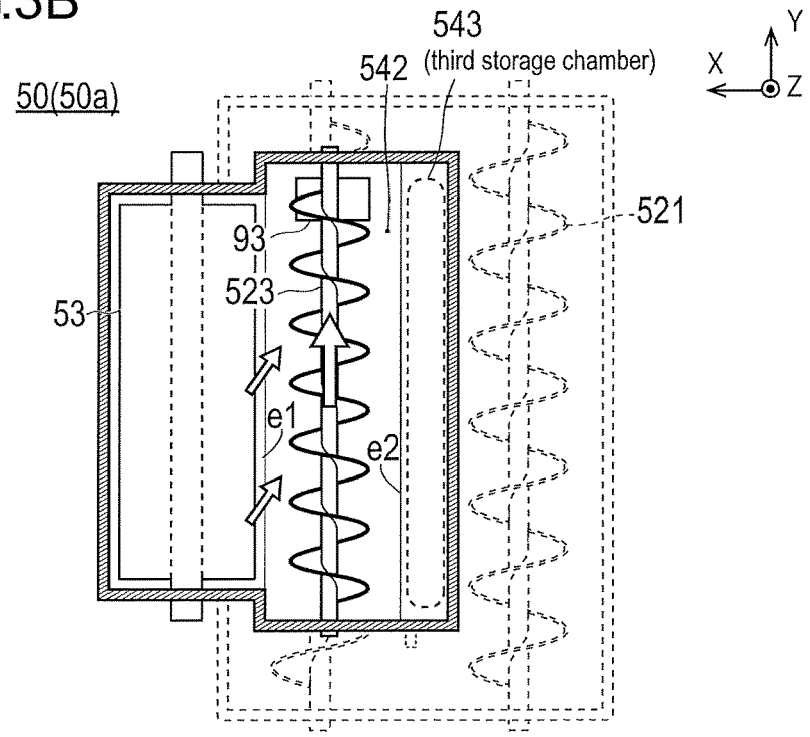
FIG. 3B is a plan view on a B-B line position in FIG. 2.

FIG. 1 is an illustration showing a schematic constitution of an image forming apparatus 100 according to one embodiment of the present invention. FIG. 2 is a cross sectional view of a developing device 50 (50*a*) according to a first embodiment. Each of FIG. 3A and FIG. 3B is a plan view on an A-A line position and a B-B line position respectively in FIG. 2.

As shown in FIG. 1, the image forming apparatus 100 includes a processor 10, an operation display 20, an image former 30, a sheet feed conveyor 40, and a toner replenisher 60.

The processor 10 includes a CPU, a RAM, a ROM, a HDD (hard disk drive), etc., and controls the whole image forming apparatus 100.

The operation display 20 includes a touch panel, a ten key, a start button, a stop button, etc., receives various kinds of settings from a user, and pedal ins display for the user.

The image former 30 includes an exposure unit 31, a photoconductor drum 32, a developing device 50, a primary transfer roller 33, an intermediate transfer belt 34, a secondary transfer roller 35, and a fixing device 36.

Among these components, each device of the exposure unit 31, the photoconductor drum 32, the developing device 50 and the primary developer transfer roller 33 includes multiple equivalent devices, and the multiple equivalent devices correspond to, in the order from the top, respective colors of Y (yellow). M (magenta), C (cyan), and K (black). In FIG. 1, for the components other than the developing device 50, a part of the respective notations of signs is omitted.

Although the details about the constitution of the developing devices 50 are described later, in each of the developing devices 50, developer in which carrier and toner with a color corresponding to one of the colors are mixed, is stored. After a surface of the photoconductor drum 32 has been electrically charged uniformly with charging electrodes (not shown), the surface is exposed with the exposure unit 31, whereby an electrostatic latent image corresponding to image data is formed on the surface of the photoconductor drum 32. The developing roller 53 and the photoconductor drum 32 are arranged so as to face each other, and a region faced between them becomes a developing position where developing is performed (refer to FIG. 2).

On this developing position, the electrostatic latent image on the photoconductor drum 32 is developed by the developing device 50, and a toner image is formed. Toner images formed separately on the respective photoconductor drums 32 are transferred with the respective primary transfer roller 33 onto the intermediate transfer belt 34 on which the toner images are superimposed on each other. Thereafter, a full color toner image formed by the superimposed toner images is transferred by the secondary transfer roller 35 onto a conveyed sheet S. The sheet on which the full color toner image has been transferred is conveyed to the fixing device 36 on the downstream side, and then, is subjected to heating and pressure applying process, whereby a full color image is formed on the sheet S.

The sheet feed conveyor 40 includes a plurality of sheet feed trays 41 and a sheet conveyance passage 42.

In the sheet feed tray 41, a plurality S of sheets S are loaded, and a sheet S is fed out one sheet by one sheet from the uppermost position. The sheet conveyance passage 42 includes a plurality of conveyance roller pairs arranged along the sheet conveyance passage 42, and driving motors (not shown) to drive these conveyance roller pairs, and conveys a sheet S fed out from the sheet feed tray 41 to the transfer position of the secondary transfer roller 35 and the fixing apparatus 36 on the downstream side of the transfer position.

On the toner replenisher 60, a plurality of toner bottles each storing developer containing toner with a color corresponding to one of the colors and carrier, are replaceably loaded, and the toner replenisher 60 conveys and replenishes developer stored inside each of the toner bottles to one of the developing devices 50 corresponding to one of the colors. In the present embodiment, the trickle development system (also called AR (Auto-Refining Developing System) system) is adopted. In the trickle development system, while a part of developer is discharged (discarded) little by little on the photoconductor, new developer is replenished, thereby suppressing the deterioration of the developer. The developer filled up in a toner bottle and replenished by the toner replenisher 60 from the toner bottle is made to have a toner weight ratio of, for example, 80 to 95%. In the developing device 50, toner is consumed by development. Accordingly, in order to maintain a predetermined toner concentration (toner weight ratio), for example, from 5% to 10%, developer containing toner in an amount corresponding to the consumption of the toner is supplied to the inside of the developing device 50 by the toner replenisher 60 via a toner replenishment port (developer supply port) 94 (refer to FIG. 3A). The replenished toner is mixed and stirred with carrier in the developing device 50 with a stirring member mentioned later, whereby the supplied toner is provided with a predetermined electric charge amount.

First Embodiment

As shown in the cross sectional view in FIG. 2, the developing device 50*a* includes a casing 51 (also referred to as a development casing) made of, for example, resin, a plurality of stirring screws 521, 522, and 523 arranged to be rotatable via a supporting member, such as a bearing, at the inside of the casing 51, and a developing roller 53. Moreover, the casing 51 includes a plurality of walls 51*a* to 51*d*, and with these walls, a first storage chamber 541, a second storage chamber 542, and a third storage chamber 543 are formed inside the casing 51 to store developer.

FIG. 3A is an illustration showing a constitution of a lower part of the developing device 50*a*. As shown in FIG. 3A, in the inside of the first storage chamber 541 at the lower part of the developing device 50*a*, a pair of stirring screws 521 and 522 are arranged side by side on the left and right sides across a central partition wall 51*d*. The first storage chamber 541 is divided into right and left chambers that are made to communicate with each other via communication ports 91 and 92 disposed on the front and rear sides respectively. Moreover, each of the stirring screws 521 and 522 includes a spiral blade disposed around a rotation shaft extended in the Y direction, and the conveyance directions of the stirring screws 521 and 522 are set opposite to each other, whereby the developer is conveyed so as to circulate clockwise as shown with an arrow in FIG. 3A within the first storage chamber 541. These stirring screws 521 and 522 function as a "first conveyor" by cooperating with each other. Moreover, at an upper part on the back side of the first storage chamber 541, a confluent opening 93 and a toner replenishment port 94 are disposed.

FIG. 3B is an illustration showing a constitution at an upper part of the developing device 50*a*. As shown in FIG. 3B, in the inside of the second storage chamber 542 at the upper part of the developing device 50*a*, a stirring screw 523 functioning as a "second conveyor" is disposed.

A part of the developer conveyed by the stirring screw 522 at the lower part is conveyed to the developing roller 53 located on an obliquely upper side. The developing roller 53 includes a plurality of magnetic poles located fixedly in the inside and a sleeve rotating around the outer peripheral surface of the magnetic poles, and supports developer on the surface of the sleeve. The developing roller 53 functions as a "developer supporter". On a position of the second storage chamber 542 facing the developing roller 53, a peeling member (also, referred to as a peeling position) in which a magnetic pole with the same polarity is arranged so as to adjoin the developing roller 53, is disposed.

The developer supplied from the stirring screw 522 at the lower side is supported on the surface of the rotating developing roller 53, passes through the developing position, is peeled off at the peeling position, and then, is conveyed to the second storage chamber 542. Thereafter, the developer is conveyed by the stirring screw 523 to the back side (arrow direction) in FIG. 3B. On the bottom of the second storage chamber 542 on the downstream side in the conveyance direction, a confluent opening 93 is disposed, and the first storage chamber 541 and the second storage chamber 542 that are disposed to become above and below each other, are made to communicate with each other via this confluent opening 93. In the second storage chamber 542, the developer conveyed to the downstream side of the stirring screw 523 is conveyed to the first storage chamber 541 from this confluent opening 93.

Moreover, as shown in FIG. 2, the second storage chamber 542 is partitioned with two side walls located along the rotation axis direction (Y direction) of the developing roller 53, i.e., a side wall 51*a* facing the developing roller 53 and a side wall 51*b* opposite to the side wall 51*a*. So as to adjoin the side wall 51*b* of the second storage chamber 542 farther from the developing roller 53, a third storage chamber 543 is disposed. As shown in FIG. 2 and FIG. 3B, a bended line e2 is extended so as to exist in the Y direction. A side wall 51*c* continued to the side wall 51*b* at the bended line e2, and includes a slope surface fl spreading upwardly to the outside. The cross section of the third storage chamber 543 viewed from the Y direction is curved, and the third storage chamber 543 is partitioned with a side wall 51*c* extended so as to exist in the Y direction.

In the case where the bulkiness (liquid level or uppermost level of developer) of the developer stored in the second storage chamber 542 moves upward and the developer overflows from the second storage chamber 542, the third storage chamber 543 stores this overflowing developer. Thereafter, in the case where the overflowing of the developer from the second storage chamber 542 is cancelled and the bulkiness of the developer moves downward, the developer slides down along the slope surface fl of the side wall 51*c* and returns to the second storage chamber 542.

Figure 4:
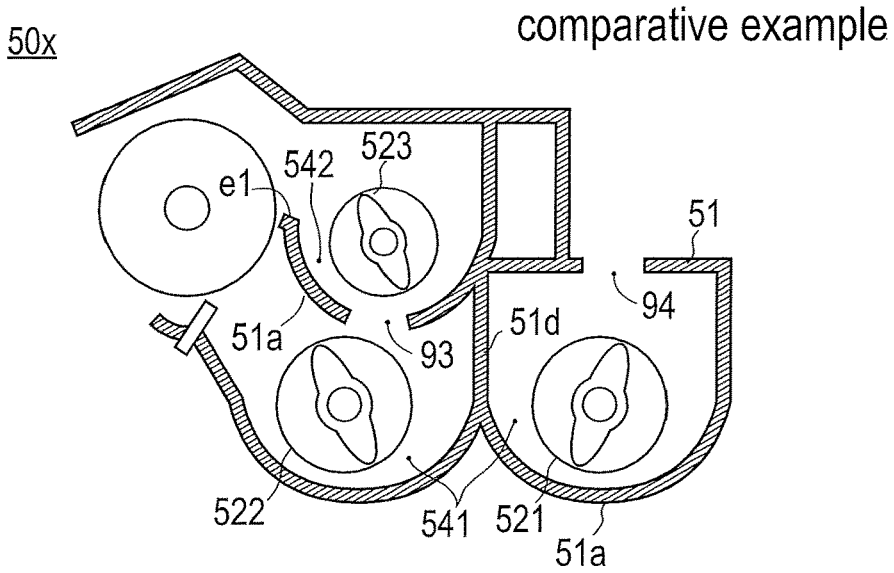
FIG. 4 is a cross sectional view of a developing device according to a comparative example.

FIG. 4 is a cross sectional view of a developing device 50*x* according to a comparative example. Hereinafter, description is given for the effects of the developing device 50*a* of the present embodiment wile comparing with the developing device 50*x*.

As compared with the developing device 50*a* shown in FIG. 2 etc. according to the first embodiment, the developing device 50*x* of the comparative example is equipped with the same constitution except a point that the third storage chamber 543 is not disposed. In the developing device 50*x* of the comparative example, in the case where the bulkiness of the developer increases due to the increasing of the amount of the developer stored in its inside, since the bulkiness of the developer in the first storage chamber 541 increases, the confluent opening 93 is closed with the developer. Accordingly, the flow of developer is inhibited, so that the amount of the developer in the second storage chamber 542 on the upstream side of the confluent opening 93 increases, and the bulkiness becomes high.

In the case where the bulkiness of the developer becomes higher than the top surface e1 of the side wall 51*a*, the flow of the developer from the developing roller 53 on the more upstream side than the second storage chamber 542 is inhibited. After toner has been consumed at the developing position from the developer having been conveyed from the first storage chamber 541 and being supported on the developing roller 53, ideally, all the developer remaining on the developing roller 53 is peeled off from the developing roller 53 at a peeling position near the top surface e1. However, in the case where developer is stagnating in the vicinity of the top surface e1, the peeling-off at the peeling position is inhibited. As a result, the developer having passed through the developing position is supported again on the surface of the developing roller 53, and thereafter, is conveyed again to the developing position. That is, due to the lowering of the peeling ability, the replacement of developer becomes insufficient. Accordingly, since the influence of the toner consumption in the previous development process performed immediately-before remains on the current development process, the lowering of image density, i.e., ghost development occurs on the current development process.

In contrast, in the developing device 50*a* according to the present embodiment, the third storage chamber 543 is disposed. Accordingly, in the case where developer overflows from the second storage chamber 542, the overflowing developer is stored in this third storage chamber 543. With this, even if the amount of developer in the developing device has increased, the increasing of the amount of developer in the second storage chamber can be suppressed. Accordingly, the peeling ability is not inhibited, and it becomes possible to prevent the occurrence of ghost development.

Second Embodiment

Figure 5:
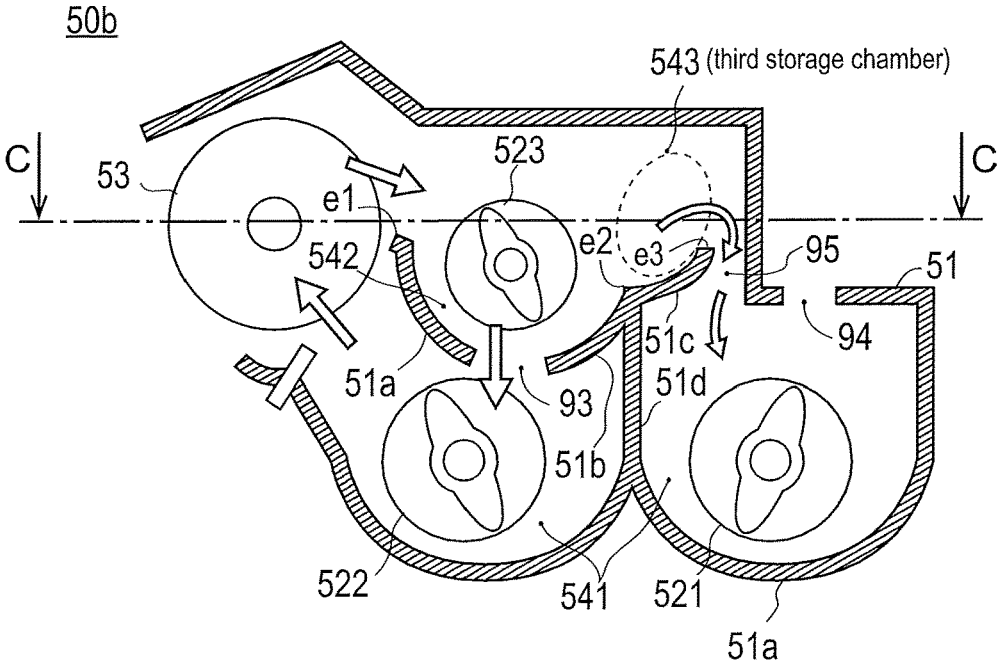
FIG. 5 is a cross sectional view of a developing device according to a second embodiment.
Figure 6:
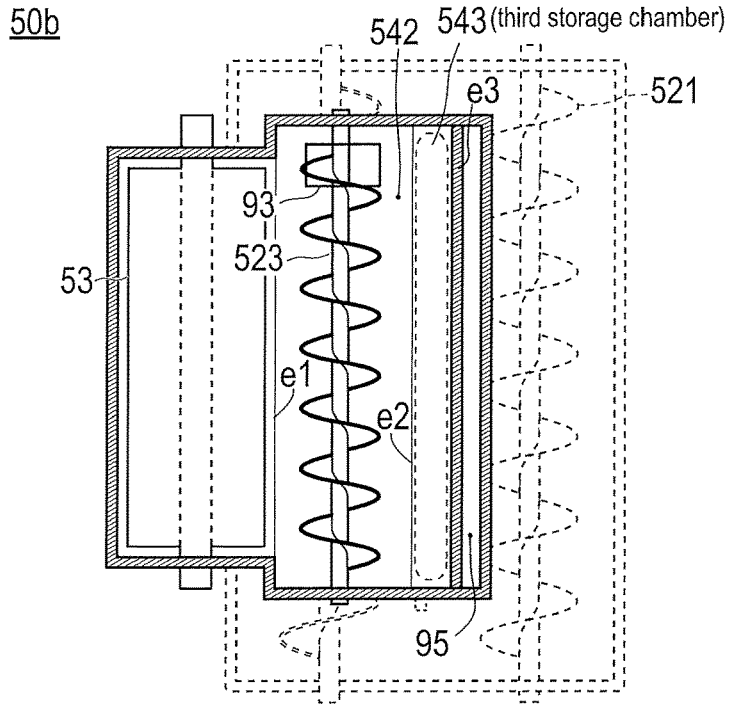
FIG. 6 is a plan view on a C-C line position in FIG. 5.

With reference to FIG. 5 and FIG. 6, a developing device 50*b* according to the second embodiment is described. FIG. 5 is a cross sectional view of the developing device 50*b*, and FIG. 6 is a plan view on a C-C line position in FIG. 5. The constitution of a lower part of the developing device 50*b* is the same as that of the developing device 50*a* according to the first embodiment shown in FIG. 3A. Accordingly, description for it is omitted.

Unlike the developing device 50*a* according to the first embodiment, in the developing device 50*b* according to the second embodiment, a communication path 95 is disposed. The communication path 95 adjoins the third storage chamber 543, is disposed on a side opposite to the second storage chamber 542, and is extended in a vertical direction. The communication path 95 connects the second storage chamber 542 on the upper side and the first storage chamber 541 on the lower side.

The height of the top surface e3 of the side wall 51*c* disposed on the communication path 95 side in the third storage chamber 543 is lower than the height of the top surface e1 of the side wall 51*a* on the side near the developing roller 53 in the second storage chamber 542. Therefore, in the case where the bulkiness of the developer stored in the second storage chamber 542 and the third storage chamber 543 exceeds the top surface e3, the developer gets over the side wall 51*c*, and falls to the first storage chamber 541 via the communication path 95. With this, the bulkiness of the developer in the second storage chamber 542 does not become higher than the top surface e1.

In this way, in the developing device 50*b* according to the second embodiment, by disposing the communication path 95, the similar effect in the first embodiment can be acquired, and in addition, it becomes possible to lower the bulkiness of developer stored in the second storage chamber 542 to the top surface e3 or less. Accordingly, it is possible to prevent effectively the occurrence of the ghost development.

Third Embodiment

Figure 7:
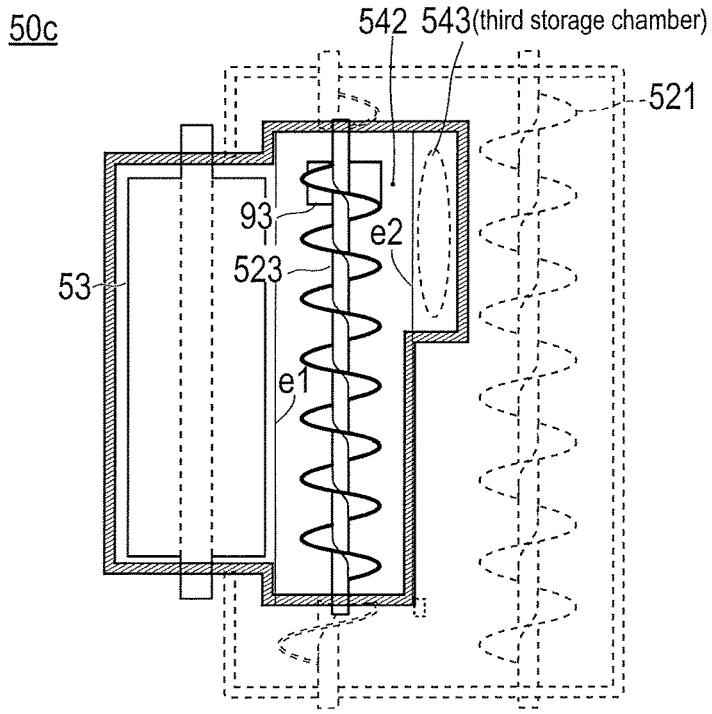
FIG. 7 is a plan view of a developing device according to a third embodiment.

FIG. 7 is a plan view which shows a developing device 50*c* according to the third embodiment and corresponds to a B-B line position in FIG. 2. The constitution of the lower part of the developing device 50*c* is the same as that of the developing device 50*a* according to the first embodiment shown in FIG. 3A. Accordingly, description for it is omitted (the same in on and after FIG. 8).

In the developing device 50*a* according to the first embodiment, the third storage chamber 543 is disposed so as to adjoin the entire region, in the Y direction, of the second storage chamber 542. In contrast, in the developing device 50*c* of the third embodiment, as shown in FIG. 7, the third storage chamber 543 is disposed only in the vicinity of the confluent opening 93, not to adjoin the entire region of the second storage chamber 542.

In the case where the bulkiness of the developer in the first storage chamber 541 increases, the conveyance of the developer from the confluent opening 93 is inhibited. In that case, in the third storage chamber 543, the developer stagnates in the vicinity of the confluent opening 93. Therefore, it is preferable to dispose the third storage chamber 543 in the vicinity of the confluent opening 93. In that case, like the developing device 50*c* of the third embodiment, even in the case where the third storage chamber 543 is disposed only in the vicinity of the confluent opening 93, it is possible to acquire the same effect as that in the developing device 50*a* according to the first embodiment.

Fourth Embodiment

Figure 8:
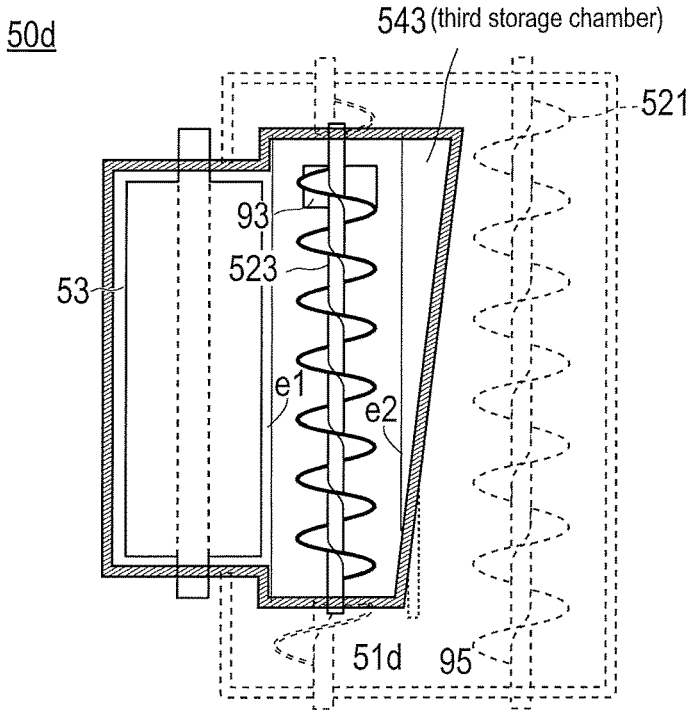
FIG. 8 is a plan view of a developing device according to a fourth embodiment.

FIG. 8 is a plan view of the developing device 50*d* according to the fourth embodiment. In the developing device 50*a* of the first embodiment, the accommodation region of the third storage chamber 543 is extended so as to exist with a uniform width in the Y direction in a plan view looked from the above side as shown in FIG. 3B. On the other hand, as shown in FIG. 8, in a developing device 50*d* according to the fourth embodiment, the accommodation region of the third storage chamber 543 is shaped in a triangular form in the planar view, and constituted such that as a cross sectional part of the accommodation region is made closer to the confluent opening 93, the cross sectional part of the accommodation region is made larger.

In the developing device 50*d* according to the fourth embodiment, by shaping the third storage chamber 543 into such a form, it becomes possible to acquire the same effect as that in the developing device 50*c* according to the third embodiment.

In the developing device of each of the third and fourth embodiments, similarly to the second embodiment, the communication path 95 may be disposed so as to adjoin the side wall 51*c* on a farther side from the developing roller 53.

In the developing devices 50*b*, 50*c*, and 50*d* corresponding to the second, third, and fourth embodiments respectively, the position of the communication path 95 is constituted such that the developer having slidden down through the inside of the communication path 95 falls in the vicinity of the stirring screw 521 on the right side of the partition wall 51*d* in the first storage chamber 541. However, the present invention should not be restricted to this example. It may be constituted such that by shifting the partition wall 51*d* relatively to the right side, the developer having passed via the communication path 95 falls to the stirring screw 522 side.

Fifth Embodiment

Figure 9:
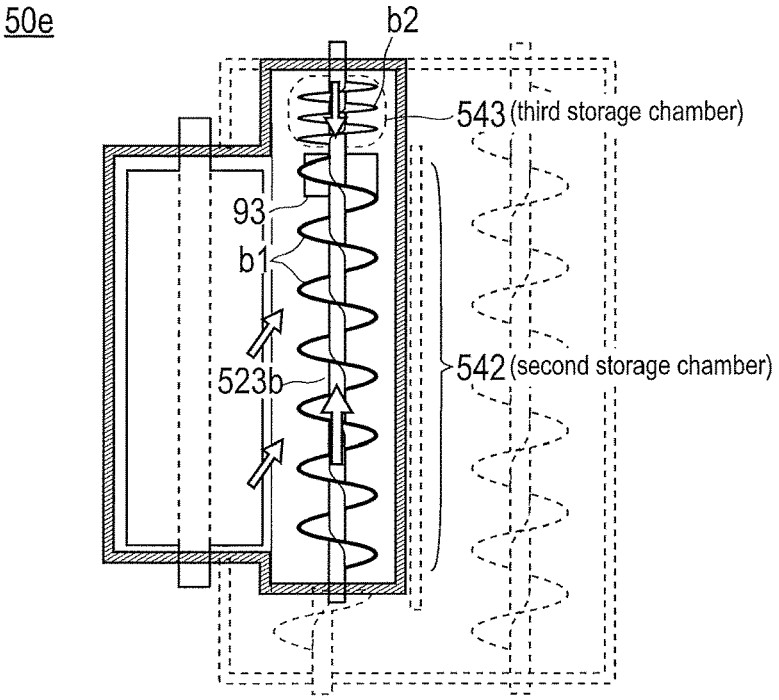
FIG. 9 is a plan view of a developing device according to a fifth embodiment.

FIG. 9 is a plan view showing a developing device 50*e* according to the fifth embodiment. In the first to fourth embodiments, the third storage chamber 543 is disposed so as to adjoin the side wall 51*b* at a farther side from the developing roller 53. In the developing device 50*e* according to the fifth embodiment, the third storage chamber 543 is disposed at one end portion closer to the confluent opening 93 among the end portions of the stirring screw 523*b* in the rotation axis direction in the second storage chamber 542. Moreover, the stirring screw 523*b* is extended also in the third storage chamber 543, and includes a spiral blade b1 located in the second storage chamber 542 and a spiral blade b2 located in the third storage chamber 543 in which the spiral direction of the spiral blade b1 is opposite to that of the spiral blade b2. Herein, the pitch of the spiral blade b2 is shorter than that of the spiral blade b1, and the conveyance force of the spiral blade b2 is weaker than that of the spiral blade b1. The spiral blade b1 conveys developer toward the confluent opening 93 in the direction to the back side, and then, the conveyed developer having passed through the confluent opening 93 is returned in the direction to the front side by the spiral blade b2.

In this way, in the developing device 50*e* according to the fifth embodiment, the developer having not been conveyed downward from the confluent opening 93 is stored in the third storage chamber 543 disposed on the end portion side of the stirring screw 523*b* in the rotation axis direction, whereby the same effect as the first embodiment can be acquired.

Sixth Embodiment

Figure 10:
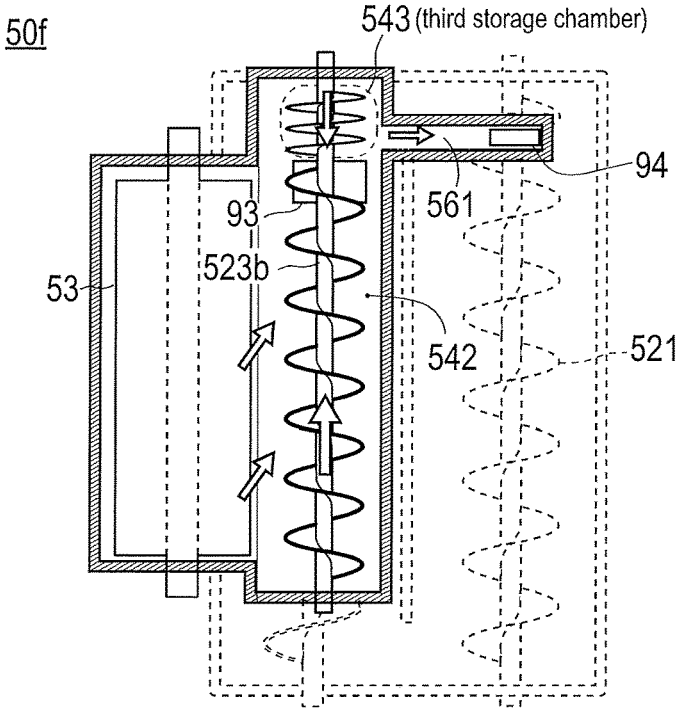
FIG. 10 is a plan view of a developing device according to a sixth embodiment.

FIG. 10 is a plan view showing a developing device 50*f* according to the sixth embodiment. In the developing device 50*f* according to the sixth embodiment, a communication path 561 connecting the third storage chamber 543 and the toner replenishment port 94 is disposed.

In the developing device 50*f*, the developer conveyed to the third storage chamber 543 is pushed out, and returns from the toner replenishment port 94 to the first storage chamber 541 via the communication path 561.

In this way, in the developing device 50*f* according to the sixth embodiment, in the case where the amount of the developer stored in the third storage chamber 543 disposed at one end portion side of the stirring screw 523*b* in the rotation axis direction increases, the developer can be directly returned from the communication path 561 to the first storage chamber 541. Accordingly, similarly to the second embodiment, it becomes possible to further lower the bulkiness of the developer stored in the second storage chamber 542, and it is possible to prevent effectively the occurrence of ghost development.

Seventh Embodiment

Figure 11:
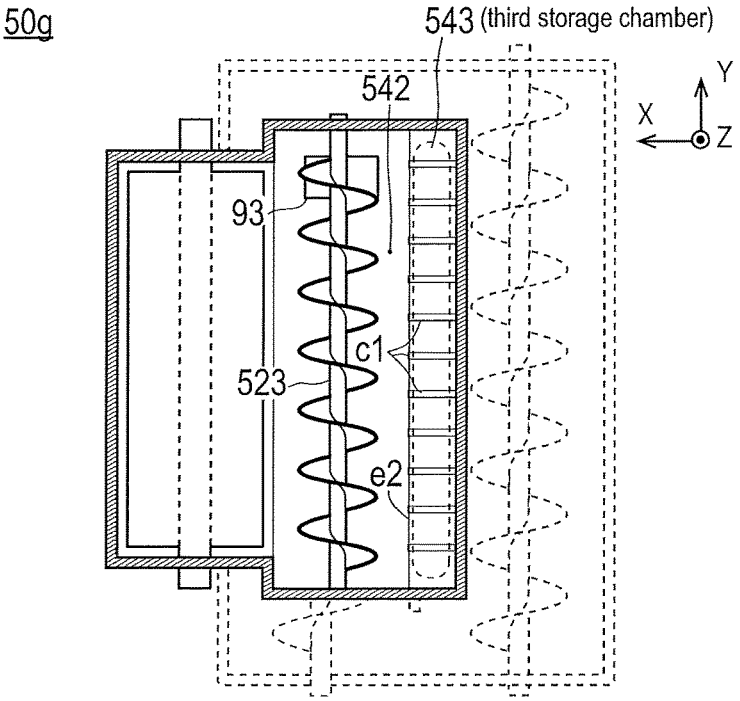
FIG. 11 is a plan view of a developing device according to a seventh embodiment.

FIG. 11 is a plan view showing a developing device 50*g* according to the seventh embodiment. In the developing device 50*g* according to the seventh embodiment, a plurality of convex portions c1 are disposed in the inside of the third storage chamber 543. Each of the convex portions c1 is a protrusion that protrudes upwardly from the slope surface fl in the inside of the third storage chamber 543 and is extended so as to exist in the X direction. These convex portions c1 are arranged side by side at predetermined intervals in the Y direction over the entire region of the third storage chamber 543. Each of these convex portions c1 functions as a wall that prevents developer in the inside of the third storage chamber 543 from moving in the Y direction. With this, the same effect as the first embodiment can be acquired, and in addition, the developer can be stored uniformly in the Y direction with the convex portions c1 without being stored unevenly in the Y direction toward the back side.

Eighth Embodiment

Figure 12:
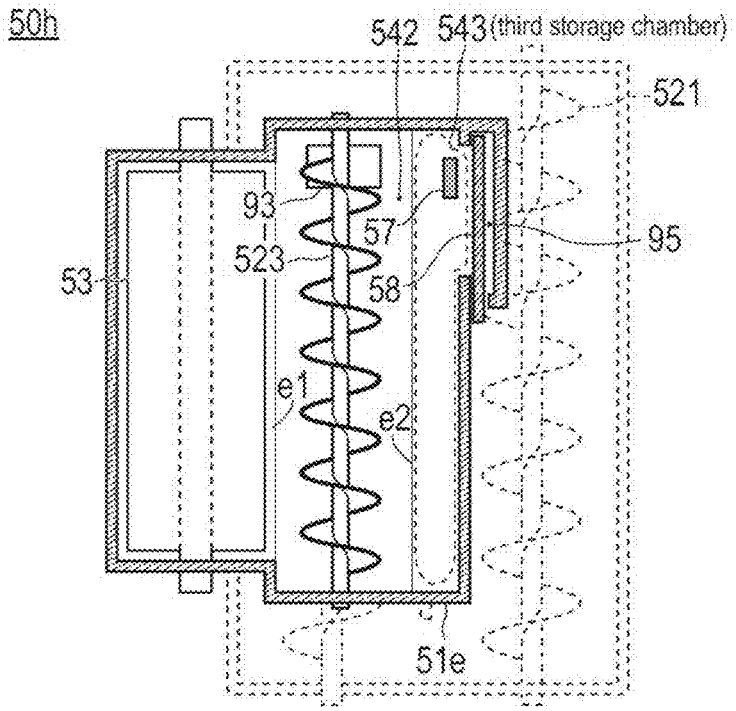
FIG. 12 is a plan view of a developing device according to an eighth embodiment.

FIG. 12 is a plan view showing a developing device 50*h* according to the eighth embodiment. The developing device 50*h* according to the eighth embodiment includes a detection sensor 57 and an opening and closing shutter (opening and closing member) 58 disposed in the third storage chamber 543. The detection sensor 57 is constituted by a piezoelectric device or an optical sensor etc., and outputs detection signals indicating the existence or nonexistence of the developer in a detection region arranged at a position with a predetermined height. The opening and closing shutter 58 is arranged in the vicinity of the confluent opening 93, and in a closed state shown in FIG. 12, the opening and closing shutter 58 closes the communication path 95 to communicate with the first storage chamber 541. In the case of opening the communication path 95 by sliding the opening and closing shutter 58 in the Y direction with a driving mechanism (not shown), the developer stored in the third storage chamber 543 is conveyed to the first storage chamber 541 via the communication path 95.

In the case where the processor 10 has determined on the basis of detection signals of the detection sensor 57 that a predetermined amount or more of developer has been stored in the third storage chamber 543, the processor 10 sets the opening and closing shutter 58 to an opening state. With this, the developer stored in the third storage chamber 543 falls to the first storage chamber 541 via the communication path 95. Thereafter, in the case where the processor 10 has determined on the basis of detection signals of the detection sensor 57 that a predetermined amount or more of developer has not been stored in the third storage chamber 543, the processor 10 switches the opening and closing shutter 58 to an closing state. In the eighth embodiment, it is preferable that the side wall 51*c* (refer to FIG. 5) is disposed on only a region where the opening and closing shutter 58 is not arranged, and that a region where the opening and closing shutter 58 is arranged is made to a flat floor without disposing the side wall 51*c*. Moreover, it is preferable that the detection region of the detection sensor 57 is set at a position lower than the height of the top surface e1 of the side wall 51*a* in the Z direction.

In this way, in the developing device 50*h* according to the eighth embodiment, by disposing the detection sensor 57 and the opening and closing shutter 58, and by controlling the opening and closing shutter 58 with the processor 10 on the basis of the detection signal of the detection sensor 57, it becomes possible to acquire the same effect in the second embodiment. In addition, by opening the opening and closing shutter 58, it becomes possible to immediately discharge the developer in the third storage chamber 543 to the first storage chamber 541, whereby it is possible to prevent the occurrence of ghost development more effectively.

Ninth Embodiment

Figure 13:
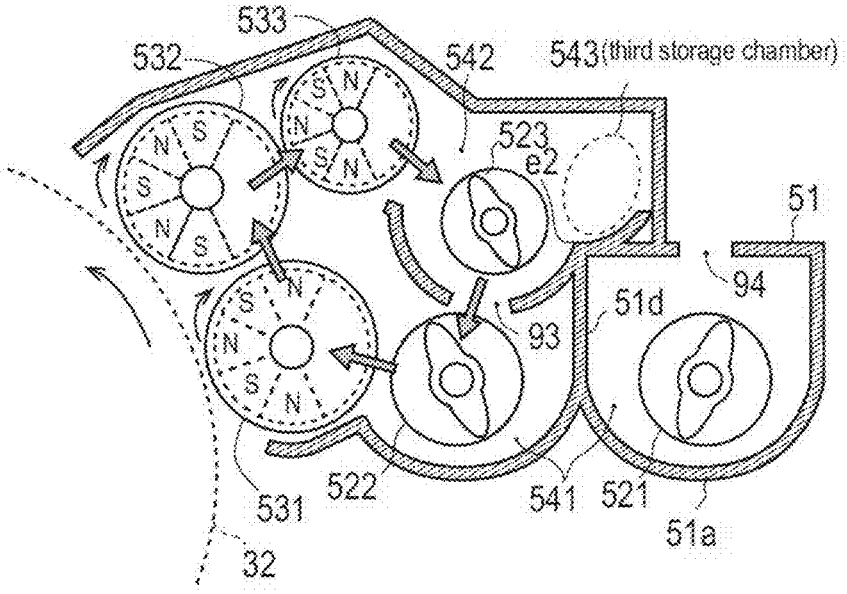
FIG. 13 is a plan view of a developing device according to a ninth embodiment.

FIG. 13 is a plan view showing a developing device 50*i* according to the ninth embodiment. The developing device 50*i* according to the ninth embodiment includes a plurality of developer supporters constituted by first and second developing roller 531 and 532 and a stripping roller 533. Here, the first and second developing roller 531 and 532 function as a "first developer supporter" by cooperating with each other, and the stripping roller 533 functions as a "second developer supporter".

Similarly to the above-described developing roller 53, each of the first and second developing roller 531 and 532 and the stripping roller 533 includes a plurality of magnetic poles arranged to be fixed in its inside and a sleeve rotating around the outer peripheral surface of the magnetic poles, and supports developer on the surface of the sleeve. For example, the outside diameter of each of the first and second developing roller 531 and 532 is 25 mm, and the outside diameter of the stripping roller 533 is 20 mm. As shown in FIG. 13, the developer conveyed from the second stirring screw 522 is sent to the downstream side in order of the first developing roller 531, the second developing roller 532, and the peeling roller 533, and is further conveyed to the second storage chamber 542.

The peeling roller 533 functions also as a "peeling member" that strips off developer supported by the second developing roller 532 and conveys the developer to the downstream side.

In the first embodiment, the example equipped with a single developer supporter (developing roller 53) has been shown. However, the developing device may be equipped with a plurality of developer supporters like the developing device 50*i* according to this ninth embodiment. Moreover, the developing device 50*i* is equipped with a plurality of developing rollers. However, the developing device may be equipped with a single developing roller and a single peeling roller. Moreover, for the developing device relating to each of the second to eighth embodiments, similarly, the constitution equipped with such a plurality of developer supporters may be applied. Further more, as the peeling member, in place of the stripping roller 533, a plate-shaped peeling plate may be constituted so as to be disposed in the vicinity of the peeling position of the developing roller 53.

In such a developing device 50*i* according to the ninth embodiment, it is possible to acquire the same effects as those in the first to eighth embodiment Example In order to verify the effects of each of the above-described embodiments, while an amount of developer in a developing device was increasing stepwise by 100 g from 1100 g to 1400 g, an occurrence situation of ghost development was evaluated on the basis of the following evaluation indexes. Herein, an amount of 1100 g is an initial developer amount on a design basis. At the time of replenishing developer including a mixture of toner and carrier from the toner replenishment port 94, in the case where the balance between a discharging amount from the developing device and a replenishing amount of developer (i.e., a consumption amount of toner corresponding to a printing rate) has collapsed, the amount of developer in the developing device may increase gradually.

(Evaluation Index)

A solid image in a form of a longitudinal band with a length of an A3 size was printed, and then, a reflected image density (ID) at each of the leading end and the trailing end of the output printed matter was measured. A change (ΔID) between the reflected image density (ID) at the leading end and the reflected image density (ID) at the trailing end was evaluated as ghost development.

ΔID=ID at an image leading end−ID at an image trailing end (Evaluation Conditions)

The developing devices used for the evaluation were as follows.

Comparative Example

Developing device 50*x* (FIG. 4)

Example 1

Developing device 50*b* (FIG. 5, FIG. 6)

Example 2

Developing device 50*a* (FIG. 2, FIG. 3A, FIG. 3B)

Example 3

Developing device 50*e* (FIG. 9)

Example 4

Developing device 50*h* (FIG. 12)

(Results)

Figure 14:
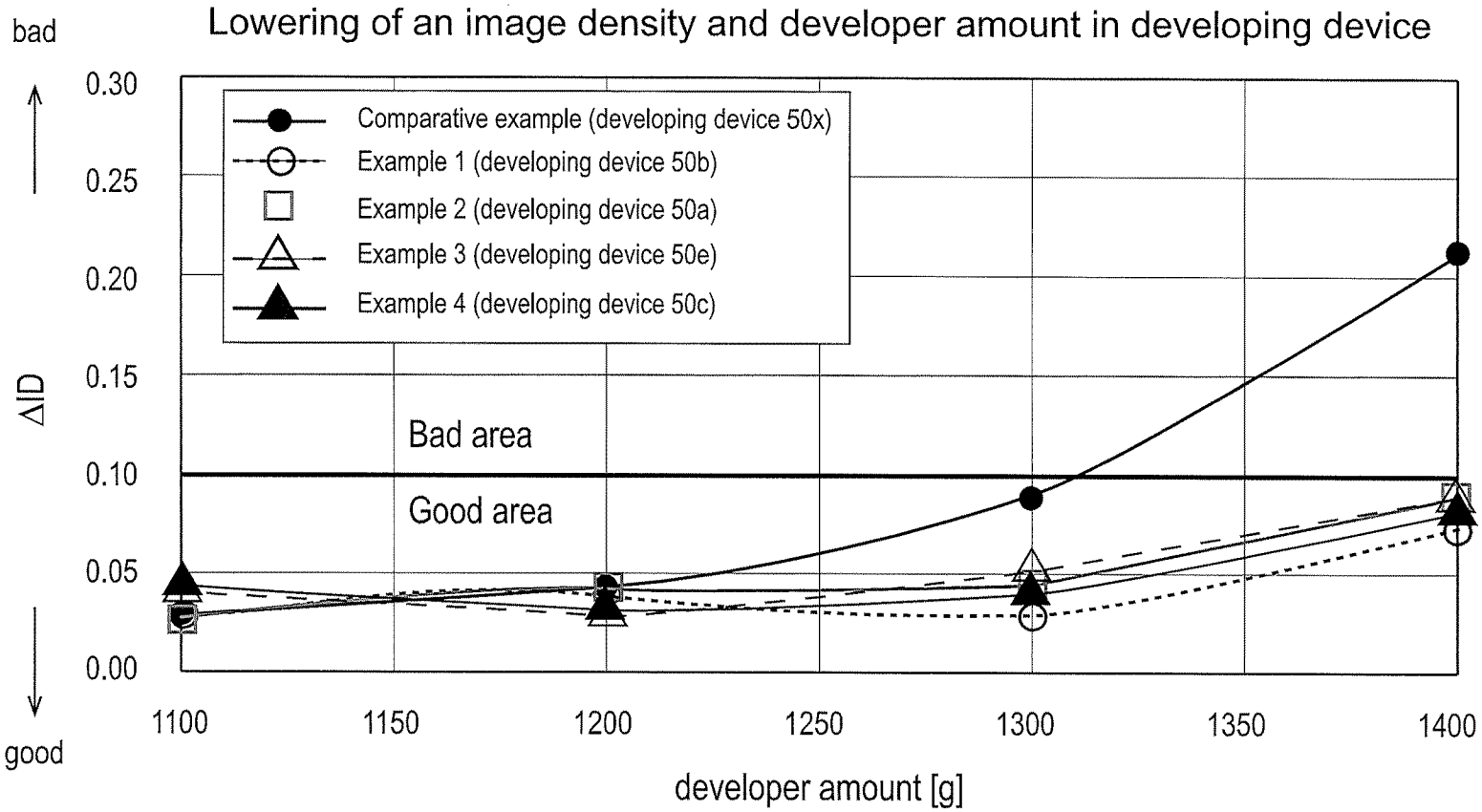
FIG. 14 is a graph showing a relationship between an amount of developer and the lowering of an image density.

The results are shown in a graph in FIG. 14. In FIG. 14, in the case where ΔID is 0.1 or more, it is determined that imaging quality is insufficient. In Comparative example, it is understood that, from a point where an amount of developer is about 1300 g, ΔID is increasing, and ghost development is occurring.

On the other hand, in Examples 1 to 4, even in the case where an amount of developer increases, ΔID does not increase. The reasons why ΔID does not increase, are as follows. An increase in an amount of developer in the second storage chamber 542 is difficult to occur. Accordingly, the replacement ability of the developer supported on the developing roller 53 does not lower due to the increasing of an amount of developer, and the peeling ability is hardly influenced.

In the above-described constitutions of the developing device and the image forming apparatus, description has been given for main constitutions in order to describe the feature of each of the above described embodiments. Accordingly, the present invention should not be limited to the above constitutions, and various modifications may be made within the scope of claims. Moreover, it is not intended to exclude the constitutions which general developing device and image forming apparatus are equipped with.

The example where two stirring screws are disposed in the first storage chamber has been shown. However, without being limited to this example, a single stirring screw or three or more stirring screws may be disposed. Moreover, the example where the spiral blade is used as a stirring screw has been shown. However, without being limited to this example, a paddle-shaped blade may be used, or a paddle-shaped blade and a spiral blade may be attached onto a single rotation shaft.

Although embodiments of the present invention have been described and illustrated in detail, the disclosed embodiments are made for purpose of illustration and example only and not limitation The scope of the present invention should be interpreted by terms of the appended claims.

What is claimed is:

1. A developing device, comprising:

a first storage chamber that stores developer;

a first conveyor that is disposed in the first storage chamber and conveys developer;

a developer supporter that is disposed so as to face an image supporter, supports developer conveyed from the first conveyor, and conveys the supported developer to a developing position where an electrostatic latent image formed on the image supporter is developed;

a second storage chamber that stores developer conveyed via the developing position and communicates with the first storage chamber at a confluent opening;

a second conveyor that is disposed in the second storage chamber and conveys developer conveyed via the developing position toward the confluent opening; and a third storage chamber that stores developer overflowing in a case where an amount of developer in the second storage chamber becomes a predetermined amount or more, wherein, in an operative position of the developing device, the second and third storage chambers are located above the first storage chamber.

2. The developing device of claim 1, wherein the third storage chamber is disposed in a vicinity of the confluent opening.

3. The developing device of claim 1, wherein the second storage chamber is surrounded with two side walls located along a rotation axis direction of the developer supporter, and the third storage chamber is disposed so as to adjoin a side wall farther from the developer supporter among the two side walls.

4. The developing device of claim 1, further comprising a communication path for communicating between the third storage chamber and the first storage chamber, wherein the developer stored in the third storage chamber is conveyed to the first storage chamber via the communication path.

5. The developing device of claim 4, wherein the first storage chamber is provided with a developer supply port to supply developer for replenishing, and the developer having passed via the communication path is further conveyed to the first storage chamber via the developer supply port.

6. The developing device of claim 1, wherein as a storage area of the third storage chamber is located closer to the confluent opening in a plan view, the storage area is constituted to become larger.

7. The developing device of claim 1, wherein the third storage chamber includes a slope surface that continues to one side wall among a plurality of side walls surrounding the second storage chamber and spreads upwardly to an outside, and the third storage chamber returns the stored developer, by making the developer fall along the slope surface, to the second storage chamber in which an amount developer has become a predetermined amount or less.

8. The developing device of claim 1, wherein the second storage chamber and the first storage chamber are disposed to be above and below each other across the confluent opening disposed on a bottom of the second storage chamber, the third storage chamber is disposed at an end portion side of the second conveyor close to the confluent opening in a rotation axis direction of the second conveyor, and the third storage chamber stores the developer having been conveyed by the second conveyor and having passed over the confluent opening.

9. The developing device of claim 1, further comprising: a peeling member to peel off the developer supported on the developer supporter on a downstream side of the developing position of the developer supporter.

10. The developing device of claim 1, wherein the developer supporter is one of a plurality of developer supporters, and the plurality of developer supporters include a first developer supporter that conveys supported developer to the developing position and a second developer supporter that peels off the developer supported on the first developer supporter on a downstream side of the developing position of the first developer supporter and conveys the peeled developer to a downstream side.

11. An image forming apparatus, comprising:

an image supporter;

a writer to form a latent image on the image supporter; and the developing device described in claim 1 that develops a latent image on the image supporter.

12. The developing device of claim 1, wherein, in the operative position of the developing device, the third storage chamber is entirely above the first storage chamber.

13. A developing device, comprising:

a first storage chamber that stores developer;

a first conveyor that is disposed in the first storage chamber and conveys developer;

a developer supporter that is disposed so as to face an image supporter, supports developer conveyed from the first conveyor, and conveys the supported developer to a developing position where an electrostatic latent image formed on the image supporter is developed;

a second storage chamber that stores developer conveyed via the developing position and communicates with the first storage chamber at a confluent opening;

a second conveyor that is disposed in the second storage chamber and conveys developer conveyed via the developing position toward the confluent opening;

a third storage chamber that stores developer overflowing in a case where an amount of developer in the second storage chamber becomes a predetermined amount or more; and a communication path for communicating between the third storage chamber and the first storage chamber, wherein the developer stored in the third storage chamber is conveyed to the first storage chamber via the communication path, wherein the third storage chamber and the first storage chamber are disposed so as to be above and below each other, the communication path is extended vertically, a height of a top surface of a side wall of the third storage chamber disposed on a communication path side is lower than a height of a top surface of a side wall close to the developer supporter among two side walls disposed along a rotation axis direction of the developer supporter and surrounding the second storage chamber, and developer having gotten over the side wall disposed on the communication path side from the third storage chamber falls into the first storage chamber at the lower side via the communication path.

14. An image forming apparatus, comprising:

an image supporter;

a writer to form a latent image on the image supporter;

a developing device that develops a latent image on the image supporter, the developing device comprising:

a first storage chamber that stores developer;

a first conveyor that is disposed in the first storage chamber and conveys developer;

a developer supporter that is disposed so as to face the image supporter, supports developer conveyed from the first conveyor, and conveys the supported developer to a developing position where the latent image formed on the image supporter is developed;

a second storage chamber that stores developer conveyed via the developing position and communicates with the first storage chamber at a confluent opening;

a second conveyor that is disposed in the second storage chamber and conveys developer conveyed via the developing position toward the confluent opening;

a third storage chamber that stores developer overflowing in a case where an amount of developer in the second storage chamber becomes a predetermined amount or more; and a communication path for communicating between the third storage chamber and the first storage chamber, wherein the developer stored in the third storage chamber is conveyed to the first storage chamber via the communication path;

a detection sensor that detects whether a predetermined amount or more of developer is stored in the third storage chamber;

an opening and closing member that opens and closes the communication path; and a processor that controls opening and closing actions of the opening and closing member in response to an output of the detection sensor, wherein the processor opens the communication path in a case where the developer is stored in the third storage chamber, and closes the communication path in a case where the developer is not stored in the third storage chamber.

* * * * *